US006231778B1

(12) United States Patent
Hansen

(10) Patent No.: US 6,231,778 B1
(45) Date of Patent: May 15, 2001

(54) AQUEOUS FOAMING FIRE EXTINGUISHING COMPOSITION

(75) Inventor: Steve W. Hansen, Green Bay, WI (US)

(73) Assignee: Ansul Incorporated, Marinette, WI (US)

( * ) Notice: Subject to any disclaimer, the term of this patent is extended or adjusted under 35 U.S.C. 154(b) by 0 days.

(21) Appl. No.: 09/474,486

(22) Filed: Dec. 29, 1999

(51) Int. Cl.[7] ..... A62D 1/02; A62D 1/04; A62C 3/00

(52) U.S. Cl. ..... 252/3; 252/8.05; 169/47

(58) Field of Search ..... 252/2, 3, 8.05; 169/47, 64, 62

(56) References Cited

U.S. PATENT DOCUMENTS

| | | | | |
|---|---|---|---|---|
| 3,661,776 | | 5/1972 | Fletcher et al. | 252/3 |
| 3,849,315 | | 11/1974 | Chiesa, Jr. | 252/3 |
| 4,439,329 | | 3/1984 | Kleiner et al. | 252/8.05 |
| 4,770,794 | | 9/1988 | Cundasawmy et al. | 252/3 |
| 4,999,119 | | 3/1991 | Norman et al. | 252/3 |
| 5,085,786 | * | 2/1992 | Atm et al. | 252/8.05 |
| 5,651,416 | * | 7/1997 | Clauson et al. | 169/46 |
| 5,676,876 | * | 10/1997 | Winkler, III | 252/3 |

* cited by examiner

*Primary Examiner*—Joseph D. Anthony
(74) *Attorney, Agent, or Firm*—Morgan & Finnegan, LLP

(57) ABSTRACT

The present invention relates to a novel fire extinguishing composition suitable for use and storage at a temperature below −1° C., said composition comprising an aqueous solution of:

v) 50–60% by weight of 60% aqueous solution of potassium acetate, vi) 7–10% by weight of a 3% solution of AFFF, vii) 15–20% by weight alkylene glycol selected from the group consisting of ethylene glycol and propylene glycol, and viii) balance being water.

12 Claims, No Drawings

AQUEOUS FOAMING FIRE EXTINGUISHING COMPOSITION

BACKGROUND OF INVENTION

The present invention relates to a novel foam-forming fire extinguishing composition that does not freeze at temperatures below 1° C. The novel fire extinguishing composition of the present invention is useful in regions where the temperature is below 1° C., such as in Alaska, the northern regions of Canada, Siberia or in the winter where extreme cold may persist and where foam-forming fire extinguishing agents are the fire extinguishing agents of choice.

In the fire extinguishing art, fires are divided into four general classes; namely, Class A, Class B, Class C and Class D.

Class A fires are those involving ordinary combustible material such as paper, wood, etc. and can be extinguished by quenching and cooling with large quantities of water or solutions containing water.

Class B fires are those involving flammable liquids fuels, gasoline, and other hydrocarbons and are difficult to extinguish. Most flammable liquids exhibit high vapor pressure along with low fire and flash points. This typically result in a wide flammability range. In this type of fire, the use of water as the sole extinguishing agent is generally ineffective because the only means of extinguishing the fire with water is through cooling.

Class C fires involve electrical equipment. Thus, the electrical conducting property of the extinguishing material is an important consideration. For this reason, it has been found that dry fire extinguishing agents are generally more useful. It has also been found that the fire extinguishing agents useful for Class A or B fires are generally also useful for Class C fires.

Class D fires involve combustible metals and are extinguished with special dry powders.

Many different fire extinguishing compositions and fire extinguishing systems using such compositions have been developed and are available on the market. However, the ability to extinguish Class A and/or Class B fires in all weather conditions and in remote regions of the globe where the temperature year round is low, remains a serious problem. The potential for a catastrophic fire in these areas is widely recognized by insurers and insured alike. Extinguishing agents and delivery systems for the protection of high value off-road mining equipment in freezing climates is of particular concern. Regularly the fire protection systems installed on this mining equipment are located on the periphery of the machine, fully exposed to the elements. Under these conditions it is necessary to have an agent that can withstand freezing temperatures for extended periods of time.

Two types of fire extinguishing agents have been developed for Class A and/or B fires: dry chemical compositions and aqueous film-forming foam (AFFF) compositions. Dry chemicals, because they are solids, are capable of use at temperatures to −40° C. or −54° C. depending only on the expellant gas used for discharge. The effectiveness of dry chemicals in extinguishing fires is well known. However, dry chemicals do not provide a means of blanketing the fuel surface to prevent reflash. Film-forming-foam compositions are preferred because foam formation provides a blanket to cover the fuel surface excluding air preventing further ignition of the fuel. For this reason film-forming foam compositions are particularly desirable for extinguishing fires involving flammable fuels, such as gasoline, naphtha, diesel oils, hydraulic fluids and other hydrocarbons.

Fletcher et al, U.S. Pat. No. 3,661,776, provided a 6% concentrate composition comprising a mixture of a fluoroaliphatic carboxylic acid and a fluorinated sulphonic acids salts as the foam forming agents together with a polyoxyethylene oxide polymer, ethylene glycol and water. Chiesa, U.S. Pat. No. 3,849,315, described a composition using a mixture of lipophilic silicon containing surfactants and fluorinated hydrocarbon compounds as film forming agents. The agents are prepared as concentrated solutions and diluted with water prior to being employed to extinguish fires. These compositions contain fluorinated compounds, also known as perfluroalkyl surfactants referred to as AFFF or ARAFFF. These compositions are used as aqueous concentrates and are diluted with water when applied to a fire. Norman et al, U.S. Pat. No. 4,999,119, further described AFFF or ARAFFF in a mixture with glycols, chelating agents, pH buffers, corrosion inhibitors in water.

Other foam forming agents have been described for use in fire extinguishing compositions. Kleiner et al., U.S. Pat. No. 4,439,329, disclosed sulfide terminated oligomers, wherein the oligomers are made up of hydrophilic acrylamide copolymerized with hydrophobic and hydrophilic monomer units to generate fire extinguishing foaming compositions.

Cundasawmy et al, U.S. Pat. No. 4,770,794 further disclosed a foam forming fire extinguishing composition suitable for forest fires. The composition comprised a salt derivative of a linear alcohol as a surfactant, an alkanolamide or a polyssacharide gum or synthetic polymer as a foam stabilizer, a polyhydric alcohol ether such as ethylene glycol as a foam booster and water.

One major disadvantage of the foam-forming fire extinguishing compositions is that these compositions require dilution with water to produce the desired extinguishing effect. Dilution with water causes the composition to freeze when stored at temperatures 1 or 2 degrees below the freezing point of water. This means that the solutions must be stored in temperature controlled facilities and that prolonged application of these compositions must be at temperatures above freezing. In many parts of the world, the temperatures in the winter months are often below 1° C. Moreover, the storage of the fire extinguishing compositions in heated or enclosed areas is often not possible.

An improved liquid fire extinguishing composition is, therefore, desired for use in locations where the temperature is below the freezing point. This is particularly useful for expensive mining equipment and airports located in regions of extreme cold.

It is known that mixtures of alkylene glycol, preferably ethylene or propylene glycol, can be used to depress the freezing point of water. It is also known that 50% by weight solution of either ethylene glycol or propylene glycol will lower the freezing point of water to below −40° C. Such solutions are widely used as "antifreeze" in automobile cooling systems and as "de-icers" for aircraft. However, it is also known that solutions containing such a high weight percent of glycols are flammable and would not be considered desirable for use in a fire extinguishing composition.

It is also known that highly concentrated solutions of potassium acetate depresses the freezing point of the solution. To depress the freezing point by 75° C. requires a solution containing 60% of potassium acetate. Typically, a solution of this concentration would be used in the aviation industry as a runway de-icer. It is also known that potassium acetate is completely biodegradable. However, it is not known to combine potassium acetate with a glycol to reduce the freezing point of an aqueous solution without having to use a high concentration of glycol which is flammable.

SUMMARY OF THE INVENTION

According to the present invention, a novel fire extinguishing composition is provided. The fire extinguishing composition comprises:

i) 50–60% by weight of a 60% potassium acetate solution, ii) 7–10% by weight of a 3% AFFF, iii) 15–20% by weight alkylene glycol selected from the group consisting of ethylene glycol and propylene glycol, and iv) 15–20% by weight water.

DETAILED DESCRIPTION OF THE INVENTION

It has been found that a fire extinguishing composition suitable for use at a temperatures ≦−10° C. comprises the following:

i) 50–60% by weight of a 60% potassium acetate solution, ii) 7–10% by weight of a 3% AFFF, iii) 15–20% by weight of an alkylene glycol selected from the group consisting of ethylene glycol and propylene glycol, and iv) 15–20% by weight water.

The present invention provides a foam-forming fire extinguishing composition which does not freeze when stored at a temperature between −10° C. and −50°C.

An AFFF concentrate, commercially available as ANSULITE® AFC5A, suitable for use in this formulation comprises the following: 1%–3% by weight of a flourosurfactant S-103 (a fluoroalkyl sodium sulfate, such as the sodium salt of 1-propanesulfonic acid, 2-methyl-, 2-1 oxo-3-(γ-ω-perflouro-C4-16 akyl)-thiopropyl-amino derivative); 2%–3% by weight of K81-84 (an nonionic fluorosurfactant, such as a C8-C20 thiol, -γ,ω -perfluoro telomers with acrylamide); 4%–6% by weight of Deriphat D-160C (monosodium N-lauryl-beta-Iminodipropionate); 1%–2% by weight of X-102 (nonylphenol); 1%–2% by weight of magnesium sulfate; 5%–10% by weight of butyl carbitol with the balance as water. This is known as 3% AFFF concentrate.

Preferably, the composition comprises: 55% by weight of a 60 wt % potassium acetate solution, 10% by weight of a 3% AFFF concentrate, 17% by weight ethylene glycol and 18% by weight water. The freezing point of this composition is measured to be −50° C. Thawing of the composition results in a completely homogeneous mix. It is found that the unique composition is more effective in extinguishing Class A and Class B fires. The combination of potassium acetate and ethylene glycol depressed the freezing point of the composition, preserved the solubility of the 3% AFFF in water and avoids a level of ethylene glycol or propylene glycol that is flammable. This is very important because there must be sufficient surfactant for foam-forming, sufficient potassium actate and alkylene glycol to depress the freezing point and yet be able to extinguish a fire at a temperature below −1° C.

The following examples further illustrate the invention.

EXAMPLE 1

A composition of this invention is made by adding each of the ingredients in turn to water.

The composition comprises:

| | |
|---|---|
| water | 18 wt %; |
| ethylene glycol | 17 wt %; |
| 3% AFFF concentrate | 10 wt %; and |
| potassium acetate, 60 wt % | 55 wt %. |

The ingredients were mixed in the order shown above. Sufficient time for mixing is allowed between each addition. Since these compounds are all solutions, the time is minimal and five to ten minutes is sufficient for complete mixing.

Conventional means of measuring the freezing point depression are not to be applied to these solutions. It is necessary to measure the freezing point using an isopropyl alcohol bath cooled with dry ice, which has a sufficiently low temperature. However, extreme care should be taken in handling both the dry ice and the dry-ice/alcohol bath as both will cause severe burns.

After mixing, the composition had the following physical properties

| | |
|---|---|
| pH | 10.0–11.5 |
| Density | 1.200 g/mL–1.205 g/mL |
| Freezing Point | −62° C.—65° C. |
| Surface Tension | 15 dynes/cm–25 dynes/cm |
| Interfacial Tension | 0.2 dynes/cm–1.0 dynes/cm |
| Spreading Coefficient | 3.0 dynes/cm–5.0 dynes/cm. |

The surface tension and interfacial tension are properties that define the spreading coefficient of one liquid over a second immiscible liquid. For a foamable solution, a positive spreading coefficient is indicative of a material that will spread over the fuel in question. During this process a very thin film is formed at the fuel/water interface. The formation of a film in conjunction with the foam generated during discharge, works to seal the fuel surface during the fir extinguishing process.

In comparison, a composition with 17 wt % ethylene glycol, 10 wt % of a 3 wt % Ansulite AFC5A, and water 73 wt % has a freesing point of about −14° C. and a composition with 17 wt % propylene glycol, 10 wt % of a 3 wt % Ansulite AFC5A, and 73 wt % water has a freezing point of −12° C.

EXAMPLE 2

A solution was prepared as in Example 1 except that propylene glycol was used in place of ethylene glycol. The solution has a composition of:

| | |
|---|---|
| potassium acetate (60 wt % solution) | 55 wt % |
| ANSULTIE ™ AFC 5A 3% AFFF | 10 wt % |
| propylene glycol | 17 wt % |
| water | 18 wt % |

After mixing the composition was found to have the following physical properties:

| | |
|---|---|
| pH | 10.71 |
| Density | 1.189 g/mL |
| Freezing Point | −51° C.—−58° C. |
| Surface Tension | 20.01 dynes/cm |
| Interfacial Tension | 0.68 dynes/cm |
| Spreading Coefficient | 2.98 dynes/cm. |

EXAMPLE 3

By way of comparison, the following composition was prepared.

| | |
|---|---|
| potassium acetate (60 wt % solution) | 55 wt % |
| ethylene glycol | 17 wt % |
| water | 28 wt % |

After mixing the composition was found to have the following physical properties:

| | |
|---|---|
| pH | 12.23 |
| Density | 1.2025 g/mL |
| Freezing Point | −62° C.—65° C. |
| Surface Tension | 54.45 dynes/cm |
| Interfacial Tension | 24.01 dynes/cm |
| Spreading Coefficient | −54.79 dynes/cm. |

The above composition does not form a film or foam.

EXAMPLE 4

A similar composition was prepared as in Example 3 except that propylene glycol was used instead of ethylene glycol.

| | |
|---|---|
| potassium acetate (60 wt % solution) | 55 wt % |
| propylene glycol | 17 wt % |
| water | 28 wt % |

After mixing the composition was found to have the following physical properties:

| | |
|---|---|
| pH | 12.43 |
| Density | 1.1895 g/mL |
| Freezing Point | −62° C.—65° C. |
| Surface Tension | 44.35 dynes/cm |
| Interfacial Tension | 18.5 dynes/cm |
| Spreading coefficient | −38.13 dynes/cm. |

This composition does not form a film or foam.

EXAMPLE 5

A further comparative composition was prepared as follows:

| | |
|---|---|
| ANSULTIE ™ AFC 5A, 3% AFFF | 7.5% |
| water | 92.5% |

The mixture had the following physical properties:

| | |
|---|---|
| pH | 8.00 |
| Density | 0.999 g/mL |
| Freezing Point | −1° C. |
| Surface Tension | 17.75 dynes/cm |
| Interfacial Tension | 2.07 dynes/cm |
| Spreading Coefficient | 3.86 dynes/cm. |

This composition forms a film and foam. However, the composition freezes at a temperature of −1° C. and is not useful at temperatures below −1° C.

EXAMPLE 6

Another comparative composition was prepared as in Example 5 except that ethylene glycol was used in place of 46.25% of the water as follows:

| | |
|---|---|
| Ansulite AFC 5A, 3% AFFF | 7.5% |
| ethylene glycol | 46.25% |
| water | 46.25% |

The mixture had the following physical properties:

| | |
|---|---|
| pH | 7.97 |
| Density | 1.059 g/mL |
| Freezing Point | −34° C. |
| Surface Tension | 18.20 dynes/cm |
| Interfacial Tension | 1.46 dynes/cm |
| Spreading Coefficient | 4.02 dynes/cm. |

EXAMPLE 7

Another comparative composition was prepared as in Example 5 except that propylene glycol was used in place of ethylene glycol:

| | |
|---|---|
| Ansulite AFC 5A, 3% AFFF | 7.5% |
| propylene glycol | 46.25% |
| water | 46.25% |

The mixture had the following physical properties:

| | |
|---|---|
| pH | 8.07 |
| Density | 1.034 g/mL |
| Freezing Point | −38° C. |
| Surface Tension | 18.92 dynes/cm |
| Interfacial Tension | 2.68 dynes/cm |
| Spreading Coefficient | 2.07 dynes/cm. |

The compositions of Example 6 was tested. A 50 sq. ft. pan filled with 2 inches of water and 2 inches of heptane. The compositions of Example 6 was discharged onto the fire through two ½ inch nozzles with one nozzle centered over the fire hazard. The discharge was make over a period of 2 min. 13 sec. without any indication that the fire was under control or being extinguished.

The composition of Example 7 was also tested in the same manner as above. With a discharge time of 2 min. 21 sec., no control or extinction of the fire was observed.

Comparative Testing

Fire performance of the above compositions was conducted utilizing fire pans of various sizes, from 20 square feet to 50 square feet. The various fire extinguishing compositions were directed to the target fire through two ½" nozzle configured with one nozzle directed to discharge at the is geometric center of the fire and the second nozzle discharging an equal volume of the fire extinguishing agent to an area outside the fire. The fire extinguishing composition was stored in a 30 gallon steel tank, pressurized by a 23 cubic foot nitrogen cartridge. Discharge to the nozzle was through a ¾ inch main supply hose branching to ½ inch through a distribution tee. The maximum length of the main supply hose is 40 feet. The branches of each of the distribution tees have a maximum length of 18 feet.

Fire performance for a foam product is measured by three general parameters, 90% control of the fire, time of extinction and application density. Application density is obtained by dividing the application rate, volume per unit time, by the size of the fire, which is either in square feet or square meters. The application rate is generally in gallons per minute. For the present purposes, the size of the test fire is measured in square foot. The unit for application density is, therefore gallons per minute per square foot.

The foam composition of Example 5 was chosen as the baseline. Using the test apparatus described above, the following results were obtained for the fire composition of Example 5 using a 50 square foot fire pan.

| 50 Square Feet Fire Pan | |
|---|---|
| 90% control time | 27 sec to 44 sec |
| Time for Extinction | 38 sec to 67 sec |
| Application density | 0.14 g/m/sq. ft. |

Fast control, or knockdown, of the fire followed by fast extinction are typical attributes for AFFF solutions, the primary reason why AFFFs are the agents of choice in fires involving hydrocarbon fuels. The positive spreading coefficients of the AFFF agents contributes to the speed at which the fires are controlled and extinguished.

The compositions of Examples 6 and 7 contain AFFF similar to the composition of Example 5. The difference is freeze protection. The compositions of Examples 6 and 7 comprise traditional freezing point depressants, ethylene or propylene glycol. The concentration of glycol use lowered the freezing point to −34° C. to −38° C. However, the quantity of alkylene glycol required to produced the compositions of Examples 6 and 7 are flammable and produces a burning surface when sprayed into a fire. Neither the composition of Example 6 or 7 was able to extinguish a pan fire of any size.

The compositions of Examples 1 and 2 were tested on fires of varying sizes using the same procedure described above with varying sizes of the fire from 20 square feet to 50 square feet at 10 square feet increments. The results show that fires of up to 40 square feet were extinguished rapidly. For the 50 square feet fire, because of the insufficient application rate of the compositions, the fire was controlled but not extinguished. The results for both compositions of Examples 1 and 2 are as follows:

| Fire Size | 90% Control Time | Extinction time | Application Density |
|---|---|---|---|
| 20 sq ft | 15 sec | 75 sec | 0.35 g/m/sq ft |
| 30 sq ft | 22 sec | 67 sec | 0.23 g/m/sq ft |
| 40 sq ft | 19–22 sec | 79–116 sec | 0.175 g/m/sq ft |
| 50 sq ft | 15–26 sec | — | 0.14 g/m/sq ft |

It is apparent from the results obtained that action of the fire was very rapid using the aqueous film-forming-foam compositions of the present invention. These compositions also demonstrate positive spreading coefficients like the conventional film-forming-foam fire extinguishing compositions.

We claim:

1. A fire extinguishing composition comprising an aqueous solution of:

i) 50–60% by weight of 60 wt. % aqueous solution of potassium acetate, ii) 7–10% by weight of a 3% solution of AFFF, iii) 15–20% by weight alkylene glycol selected from the group consisting of ethylene glycol and propylene glycol, and iv) the balance being water.

2.A fire extinguishing composition of claim 1 comprising:

i) 55% by weight of 60 wt. % aqueous solution of potassium acetate, ii) 10% by weight of a 3% solution of AFFF, iii) 17% by weight alkylene glycol selected from the group consisting of ethylene glycol and propylene glycol, and iv) the balance being water.

3. A fire extinguishing composition of claim 1 or 2 wherein the alkylene glycol is ethylene glycol.

4. A fire extinguishing composition of claim 1 or 2 wherein the alkylene glycol is propylene glycol.

5. A fire extinguishing composition of claim 3 wherein the AFFF component comprises: 1%–3% by weight of a fluoroalkyl sodium sulfate surfactant, 2%–3% by weight of a nonionic fluorosurfactant, 4%–6% by weight of monosodium N-lauryl-beta-Iminodipropionate; 1%–2% by weight of nonylphenol, 1%–2% by weight magnesium sulfate, 5%–10% by weight of butyl carbitol, and the balance being water.

6. A fire extinguishing composition of claim 4 wherein the AFFF component comprises: 1%–3% by weight of a fluoroalkyl sodium sulfate surfactant, 2%–3% by weight of a nonionic fluorosurfactant, 4%–6% by weight of monosodium N-lauryl-beta-Iminodipropionate; 1%–2% by weight of nonylphenol, 1%–2% by weight magnesium sulfate, 5%–10% by weight of butyl carbitol, and the balance being water.

7. A method of extinguishing a fire at a temperature below −1° C. by applying a composition according to claim 1.

8. A method of extinguishing a fire at a temperature below −1° C. by applying a composition according to claim 2.

9. A method of extinguishing a fire at a temperature below −1° C. by applying at a rate of at least 1.5 g/m/sq.ft., a composition according to claim 3.

10. A method of extinguishing a fire at a temperature below −1° C. by applying at a rate of at least 1.5 g/m/sq.ft., a composition according to claim 4.

11. A method of extinguishing a fire at a temperature below −1° C. by applying at a rate of at least 1.5 g/m/sq.ft., a composition according to claim 5.

12. A method of extinguishing a fire at a temperature below −1° C. by applying at a rate of at least 1.5 g/m/sq.ft., a composition according to claim 6.

* * * * *